United States Patent [19]

Bannister

[11] 4,111,830

[45] Sep. 5, 1978

[54] METHOD OF INHIBITING CORROSION

[76] Inventor: Ramon A. Bannister, P.O. Box 593, Sullivan's Island, S.C. 29482

[21] Appl. No.: 727,416

[22] Filed: Sep. 29, 1976

[51] Int. Cl.[2] ..... C09K 3/00

[52] U.S. Cl. ..... 422/17; 176/38; 252/388; 252/387; 422/19

[58] Field of Search ..... 252/387, 388; 21/2.7 R, 21/2.5 R; 176/38

[56] References Cited

U.S. PATENT DOCUMENTS

| | | | |
|---|---|---|---|
| 3,151,087 | 9/1964 | Ryznar et al. | 252/387 |
| 3,880,585 | 4/1975 | Hess et al. | 252/387 |

*Primary Examiner*—Benjamin R. Padgett
*Assistant Examiner*—Josephine L. Barr

[57] ABSTRACT

A method of retarding corrosion of metal parts in an aqueous-containing fluid system which comprises, adding to the aqueous-containing fluid system a mixture of a water-soluble cation of mercury and a water-soluble cation of a Group IB or Group IIB metal.

7 Claims, No Drawings

METHOD OF INHIBITING CORROSION

BACKGROUND OF THE INVENTION (1) Field of the Invention

This invention relates to inhibiting and retarding corrosion of metal parts in industrial aqueous-containing systems. More particularly, this invention relates to using a synergistic mixture of certain water-soluble cations to inhibit corrosion of metal parts, especially corrosion of stainless steel exposed to a chloride-ion containing fluid.

Corrosion and cracking in stainless steel results from the simultaneous action of tensile stress and a chloride-oxygen containing environment. The chloride-bearing electrolytes are recognized as being a source of cracking of austenitic stainless steels; and although there is not complete agreement on the mechanism by which the chloride-ion attacks the steel, it is recognized as being the culprit.

Cracking occurs readily in stainless steel specimens immersed in aqueous-containing fluids having only a few parts per million (ppm) of chloride-ions. The temperature of the chloride-ion containing fluids is not particularly significant in producing such cracking as, in addition to producing cracking at boiling temperatures and above, fluid temperatures as low as 30° C. even in such dilute solutions have been known to produce cracking in stainless steel. Furthermore, such cracking appears to occur in specimens both stressed and unstressed; and there appears to be little difference between the resistance of stainless steel to cracking between the various types of stainless steel.

Efforts have been made to eliminate the chloride-ions from fluid systems with which the stainless steel is contacted to thereby reduce stress cracking. In the nuclear reactor field, particularly in the power generating nuclear reactor plant, conduits such as pipes, tubing, pipe fitting, etc., are generally formed from stainless steels; and in such reactors, it is extremely important to eliminate any cracking in the conduits since repair or replacement is difficult or at best extremely costly from the standpont of down-time when corrosion and cracking occur. It is, therefore, the common practice to subject the fluid systems, usually water, used in reactors to extensive purification processes to eliminate the chloride-ion. Due to the vast quantitites of fluids used in the reactors, such purification processes are extremely expensive and utilize equipment of extremely high cost. Furthermore, even though the processed fluids are subjected to such purification processes, some traces of the chloride-ion generally remain so that stress cracking and corrosion cannot be precluded.

(2) The Prior Art

A major problem in industrial fluid handling systems is the corrosion of metal parts which are in contact with the fluids in the system. Such metal parts are for the most part iron and steel, especially stainless steel, although other metals have been used. The use of stainless steel has gained widespread use because of its natural corrosion resistance in many industrial applications, such as boilers, power plants, desalinization plants, electric utility plants and nuclear reactors Because stainless steel has such widespread usage, considerable research efforts have been made into reducing or eliminating such corrosion since not only is stainless steel expensive, but the cost of plant operations is considerably increased for shutdown and repair of corroded or cracked stainless steel components. Furthermore, the incidence of failures of metal parts is aggravated by chloride-bearing electrolytes. It has heretofore been suggested in U.S. Pat. No. 3,880,585 to Hess et al. that cracking of stainless steel may be substantially reduced by contacting stainless steel with a water-soluble mercuric ion. Although the process suggested in Hess et al. produces significant reduction of cracking and corrosion of stainless steel, it has been found that when the water-soluble mercuric cation is combined with certain other water-soluble metal cations that a synergism results to more effectively reduce corrosion than either metal cation alone.

It is, therefore, the general object of this invention to provide a method for retarding corrosion and cracking of metal parts in a fluid system.

Another object of this invention is to provide a method for reducing stress cracking of stainless steel in contact with a chloride-ion containing fluid.

Still another object of this invention is to provide a method for retarding or inhibiting corrosion of metal which includes a mixture of two water-soluble metal cations to produce a synergistic result.

Yet another object of this invention is to provide a simple, easy method of inhibiting corrosion of metal by contacting the metal with small quantities of water-soluble cations.

Other objects, features and advantages of this invention will become apparent from the following description.

SUMMARY OF THE INVENTION

The objects of this invention are accomplished by treating the fluid in a system, such as water of a nuclear reactor, to retard the corrosion of the metals which contact the fluid in the system by adding to the fluid a mixture of a water-soluble mercuric-ion in at least a corrosion inhibiting amount and a water-soluble cation of a Group IB or Group IIB metal also in a corrosion inhibiting amount. The use of such a mixture for corrosion inhibition acts synergistically to inhibit corrosion better than either used alone.

DETAILED DESCRIPTION OF THE INVENTION

Basically, the method of the invention comprises the protection of metal parts in contact with fluid systems, preferably aqueous containing fluid systems, against corrosion by the addition thereto of a mixture of a water-soluble mercuric-ion and a water-soluble cation of a Group IIA or Group IIB metal. The mixture of water-soluble metal cations is normally simply added to the fluid system in corrosion inhibiting amounts where it contacts the metal surfaces as the fluid is circulated through the system and thereby coats the metal surface. Of course, the mercuric-ion in its salt form and the other metal cation may be added to the fluid separately as they will mix together during circulation or they may be premixed.

Among the water-soluble mercuric-ions which have produced satisfactory results are mercuric nitrate, mercuric acetate, and mercuric cyanide. Care must be taken with using these water-soluble mercuric salts as they are toxic. Other mercuric salts, such as mercuric sulfate, mercuric phosphate and the like, are not useful in the method of this invention because they are insoluble in water or decompose. A sufficient amount of water-soluble mercuric salt is added to an aqueous-containing fluid system to inhibit or retard corrosion. Even the addition of quite small amounts shows some improvement; however, the desired addition is from 2 to 5,000 parts per million, preferably 10 ppm to 1,000 ppm.

The other metal cations used to mix with the mercuric ion are metals found in Group IB and Group IIB of the Periodic Table. Among the metal cations found to be effective for use in this invention from Group IB are copper, silver and gold. Among the water-soluble cations from Group IIB found to be effective are zinc and cadmium in addition to, of course, mercury. It has also been found that water-soluble salts of lead are also effective. Exemplary of water-soluble salts of the above described metal cations are salts of nitrates and salts of sulfonated lignins. The water-soluble metal salts are added to the fluid in a corrosion inhibiting amount, usually from 1 part to 50,000 parts per million (ppm) being sufficient, preferably 5 ppm to 10,000 ppm.

As has been pointed out, the addition of either the water-soluble mercuric ion alone or the water-soluble other metal cation alone results in some improvement in corrosion inhibition; but it is the combination or mixture of the two which results in the synergism observed. It is believed that the combination of mercury with the other metal cation forms an amalgam in the fluid system, which amalgam serves to form a hard coating on the metal surface to thereby prevent corrosion and cracking. As used herein, the term "fluid" is meant to include those materials normally liquid that cause corrosion in boilers, pipes, fitting and the like. The fluids are predominately water but may include other corrosion causing liquids.

The predominance of metals used in cooling systems, boilers and the like includes stainless steel and iron; and although the corrosion inhibiting effects of the process are most pronounced on stainless steel, the process of this invention is likewise applicable to carbon steel, iron and aluminum.

The practice of this invention will clearly be seen in the following examples.

Test Conditions

Various examples were conducted to illustrate the synergistic effects of the method of this invention. The metal strips used for the specimens of the examples were Type 304 stainless steel, hot-rolled, annealed and pickled with a 2B finish and with edges polished with 80–120 grit. The specimens were 0.5 inches wide, 2.0 inches long and 0.0156 inches thick. One end was bent in a U-shaped configuration over a 0.375-inch madrell. The strips were cleaned and degreased with acetone and dried with methanol.

The cleaned metal specimens described above were suspended in the various test solutions to some of which were added the water-soluble cations of this invention and visually observed for cracking. The water of the test solutions was distilled water. Make-up solution was added having the same additive concentrations to maintain the original volume of the test solution throughout the tests. During the tests, the solutions were at room temperature.

EXAMPLE 1

This example illustrates that increased corrosion inhibition and retardation are achieved using a mixture of mercuric ion and a metal cation from Group IIB, zinc. The test solution contained 38,000 ppm of HCl. Two specimens were observed in each test solution, and the times to crack were averaged. Table I below shows the comparative tests of adding mercuric nitrate (Test No. 2) and a mixture of mercuric nitrate and zinc nitrate (Test No. 3).

TABLE I

| Test No. | Additive | ppm. | Time to Crack (hrs.) |
|---|---|---|---|
| 1 | None | — | 112 |
| 2 | $Hg(NO_3)_2$ | 500 | 4,652 |
| 3 | $Hg(NO_3)_2$ | 500 | 27,720 |
| | $Zn(NO_3)_2$ | 50 | |

These results show the outstanding retarding effects of the additive mixture. At the time of cracking the acid content remained quite strong.

Additional specimens from Test No. 3 were left in the test solution for 20 hours, removed, washed in methanol and air dried for 23 hours. They were then returned to a test solution containing 38,000 ppm. HCl without additives and cracking was not observed until 14,760 hours.

EXAMPLE 2

The results shown in Table II below represent the visual observation of cracking using additive mixtures exemplary of metal cations from Group IB mixed with mercuric nitrate. The additives from Group IB included a copper cation and a silver cation. Several specimens were placed in each test solution.

TABLE II

| | mercuric nitrate | | 500 ppm. |
|---|---|---|---|
| | hydrochloric acid | | 38,000 ppm. |
| | nitrate anion | | 35 ppm. |
| Test No. | Metal Cation | ppm. | Time to Cracking (hrs.) |
| 1 | none | — | 112 |
| 2 | mercuric (alone) | 500 | 4,652 |
| 4 | cupric | 50 | 19,760 |
| 5 | silver | 50 | 19,760 |

An additional specimen treated with mercuric ions and copper ion was left in Test Solution No. 4 for 20 hours, removed, washed in methanol and air dried for 23 hours. It was returned to a test solution containing 38,000 ppm. HCL without additives and cracking was not observed until approximately 14,760 hours.

EXAMPLE 2A

A specimen was removed from each of Test Solutions No. 2, No. 4 and No. 5 in Example 2 after 840 hours of testing. These specimens were placed in a boiling solution of 42% $MgCl_2$ and observed for cracking.

TABLE IIA

| Test No. | Number of Specimen | Additional Time of Testing | Cracked |
|---|---|---|---|
| 2A | 10 | 30 minutes | yes |
| 4A | 2 | 1,014 hours | no |
| 5A | 10 | 1,014 hours | no |

EXAMPLE 3

This example illustrates that increased corrosion inhibition and retardation are achieved using a mixture of water-soluble mercuric ion and a water-soluble lead cation. The results are shown in Table III.

TABLE III

| | |
|---|---|
| mercuric nitrate | 500 ppm. |
| hydrochloric acid | 38,000 ppm. |

TABLE IV

| Test No. | MERCURY Initial (ppm.) | MERCURY 60 Second Contact | MERCURY 48 HR. Contact | LEAD Initial (ppm.) | LEAD 60 Second Contact | LEAD 48 Hr. Contact | COPPER Initial (ppm.) | COPPER 60 Second Contact | COPPER 48 Hr. Contact | ZINC Initial (ppm.) | ZINC 60 Second Contact | ZINC 48 Hr. Contact |
|---|---|---|---|---|---|---|---|---|---|---|---|---|
| 8a | 5300 | 5300 | 230 | 500 | 490 | 480 | | | | | | |
| 8b | 5300 | 5300 | 132 | | | | 100 | 100 | 96 | | | |
| 8c | 5300 | 5300 | 192 | | | | | | | 175 | 170 | 165 |
| 9a | 475 | 475 | 73 | 55 | 53 | 53 | | | | | | |
| 9b | 475 | 475 | 58 | | | | 25.5 | 25 | 24.4 | | | |
| 9c | 475 | 475 | 35 | | | | | | | 21 | 21 | 10.5 |
| 10a | 50 | 48 | 12 | 32 | 30 | 29 | | | | | | |
| 10b | 50 | 46 | 7 | | | | 10.3 | 8.5 | 8.3 | | | |
| 11a | 45 | 41 | 40 | | | | | | | 11[a] | 9.5 | 9.5 |
| 11b | 475 | 475 | 473 | | | | | | | 69[a] | 64 | 53 |
| 11c | 2800 | 2700 | 2700 | | | | | | | 115[a] | 105 | 104 |

Note: [a]100 ppm. muriatic acid.

| Test No. | Additive | ppm. | Time to Crack (hrs.) |
|---|---|---|---|
| 1 | None | | 112 |
| 6 | $Hg(NO_3)_2$ | 500 | 4,652 |
| 7 | $Pb^{++}$) | 50 | 27,720 |
| | $NO_3^-$) | 35 | |

These results clearly illustrate the synergism obtained from the mercuric-ion/lead-ion mixture over mercuric ion alone.

EXAMPLE 4

Metal specimens of stainless steel, carbon steel and aluminum were exposed to a agitated test solution containing 38,000 ppm. HCl and 5,000 ppm. mercuric nitrate for 5 minutes. Each specimen was removed and put into a second agitated test solution comprising separate containers of distilled water containing 50,000 ppm. of water-soluble cations of lead, zinc and copper, respectively. An adhesive tape strip was placed over a portion of each specimen prior to exposure to the first test solution. The specimens were removed after exposure in the second test solution for 10 minutes, and the adhesive strip was removed and a visual comparison of the treated and untreated metal surfaces observed. In each observation, it was clear that enough of the metal cation collides with the mercuric ion to form a measurable hard coating on the metal specimen. It is thought this coating provides the metal with its corrosion inhibiting characteristics.

EXAMPLE 5

This example is to provide definitive results as to the coating observed on stainless steel specimens using the process of this invention. Stainless steel specimens (Type 304) were placed in unagitated test solutions containing 38,000 ppm. HCl. Each test solution contained varying amounts of mercuric nitrate and water-soluble metal cations of lead, copper and zinc at various levels as shown in Table IV. At given time intervals, the amounts of metal cations remaining in solution were measured on an Atomic Absorption Machine and are indicated in Table IV. The difference in the amount of metal cation in solution and that initially in solution is the amount absorbed or coated on the specimen.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. A method of inhibiting corrosion of metals which contact aqueous containing fluids which comprises, adding to the fluid a synergistic mixture of water soluble cations in a corrosion inhibiting amount, said synergistic mixture consisting essentially of a mercuric cation and a metal cation selected from the group consisting of Group IB metals, Group IIB metals, and lead; and contacting the metal with the corrosion inhibiting fluid.

2. The method according to claim 1 wherein said fluid is an aqueous chloride-ion containing fluid.

3. The method according to claim 2 wherein said water-soluble mercuric ion is a member of the group consisting of mercuric nitrate, mercuric acetate and mercuric cyanide.

4. The method according to claim 3 wherein the concentration of mercuric ion is from 2 parts per million to 5,000 parts per million and the concentration of water-soluble metal cation is from 1 part per million to 50,000 parts per million.

5. The method according to claim 3 wherein said water-soluble metal cation is selected from the group consisting of zinc, cadmium, copper, gold, silver and lead.

6. The method according to claim 1 wherein said metal is selected from the group consisting of stainless steel, carbon steel, iron and aluminum.

7. The method according to claim 3 wherein the concentration of mercuric ion is from 10 ppm. to 1,000 ppm. and the concentration of water-soluble metal cation is from 5 ppm. to 10,000 ppm.

* * * * *